US011338891B2

(12) United States Patent
Egger et al.

(10) Patent No.: US 11,338,891 B2
(45) Date of Patent: May 24, 2022

(54) KITEBOARD

(71) Applicants: Jörg Egger, Salzburg (AT); Alexander Iseinoski, Obertrum am See (AT)

(72) Inventors: Jörg Egger, Salzburg (AT); Alexander Iseinoski, Obertrum am See (AT)

(73) Assignee: Alexander Iseinoski, Obertrum am See (AT)

( * ) Notice: Subject to any disclaimer, the term of this patent is extended or adjusted under 35 U.S.C. 154(b) by 0 days.

(21) Appl. No.: 16/767,976

(22) PCT Filed: Nov. 27, 2018

(86) PCT No.: PCT/EP2018/082723
§ 371 (c)(1),
(2) Date: May 28, 2020

(87) PCT Pub. No.: WO2019/105942
PCT Pub. Date: Jun. 6, 2019

(65) Prior Publication Data

US 2020/0369348 A1 Nov. 26, 2020

(30) Foreign Application Priority Data

Nov. 29, 2017 (CH) ..... 01455/17

(51) Int. Cl.
*B63B 32/40* (2020.01)
*B63B 32/53* (2020.01)

(52) U.S. Cl.
CPC ..... *B63B 32/40* (2020.02); *B63B 32/53* (2020.02)

(58) Field of Classification Search
CPC ..... B63B 32/00; B63B 32/40; B63B 32/53; B63B 35/00; B63B 35/79; B63B 35/7906; B63B 7/00; B63B 7/02
(Continued)

(56) References Cited

U.S. PATENT DOCUMENTS 3,409,920 A * 11/1968 Brownley ..... B63B 32/53 441/74
4,807,549 A 2/1989 Rhodes
(Continued)

FOREIGN PATENT DOCUMENTS

CN 203345156 U 12/2013
DE 86 33 532 U1 2/1987
(Continued)

OTHER PUBLICATIONS

EPO (Riswijk, NL), English language version of the International Search Report, Form PCT/ISA/210, for International Application PCT/EP2018/082723, dated Mar. 1, 2019 (3 pages).
(Continued)

*Primary Examiner* — Lars A Olson
(74) *Attorney, Agent, or Firm* — Pauley Erickson & Swanson

(57) ABSTRACT

A kiteboard includes a base, a front extension and/or a back extension. The base includes a top face and a bottom face and an outer edge face. The outer edge face is extending in a circumferential direction along an outer contour of the top face and the bottom face and includes a first mechanical interface. The front extension and/or the back extension include a top face and a bottom face and an inner edge face. The inner edge face extends between the top face and the bottom face along an inner contour and corresponds at least partially to the outer contour of the base. The inner edge face further includes a second mechanical interface, such that in an assembled position the first and the second mechanical inter-face are engaged with each other to position the front extension and/or the back extension with respect to the base.

20 Claims, 3 Drawing Sheets

(58) Field of Classification Search
USPC ..... 441/74, 65
See application file for complete search history.

(56) References Cited

U.S. PATENT DOCUMENTS

| | | | | |
|---|---|---|---|---|
| 7,121,909 | B1 * | 10/2006 | Meyerhoffer | B63B 32/53 441/74 |
| 7,390,234 | B2 * | 6/2008 | Peach | B63B 32/53 441/74 |
| 9,650,114 | B1 | 5/2017 | Maresh | |
| 2015/0104985 | A1 * | 4/2015 | Langelaan | B63B 32/00 441/74 |

FOREIGN PATENT DOCUMENTS

| | | | |
|---|---|---|---|
| DE | 200 22 006 | U1 | 3/2001 |
| DE | 202014006073 | | 9/2014 |
| GB | 2 469 504 | A | 10/2010 |
| WO | WO 06118969 | A1 | 9/2006 |
| WO | WO 2007/050473 | A2 | 5/2007 |

OTHER PUBLICATIONS

EPO (Riswijk, NL), English language version of Written Opinion of the Int'l Searching Authority, Form PCT/ISA/237, for Int'l Appln. PCT/EP2018/082723, dated Mar. 1, 2019 (5 pages).

* cited by examiner

KITEBOARD

BACKGROUND OF THE INVENTION

Field of the Invention

The present invention relates to a kiteboard according to the patent claims.

Discussion of Related Art

Performance characteristics of kiteboards can vary widely depending on the shape of the board, the weather and water conditions. Thus, most users own various kiteboards with different performance characteristics to compensate these effects. Next to being expensive, this has the disadvantage of a high demand of storage space as well as transportation space, if various boards need to be brought along to the water side due to unknown weather and water conditions.

Water boards, such as e.g. surfboards, sail or paddle boards with different configurations, are known. In the following some examples shall be given on adaptable water boards known from the prior art.

U.S. Pat. No. 9,650,114, published on the 16, May 2017 by Maresh Joseph, relates to a modular floating board. The modular floating board has a nose module, a tail module and an intermediate module. The modules may be coupled together to a functional floating board by an interface connection established between the intermediate module and the nose and tail modules. A tensioning member may compress the modules in longitudinal alignment and prevent the modules of the assembled board from separating. Each of the modules is on its own non-functional.

WO06118969A1, published on the 9, Nov. 2006 by Thomas Meyerhoffer, discloses a system of interchangeable components including various front panels, rear panels, adaptors, and interfaces that can be variably and removably assembled to form various customized waterboards with various performance characteristics.

DE202014006073, published on the 25, Sep. 2014 by Skywalk GmbH and Co KG, discloses a separable board with at least two parts, which are connectable via a connection device. The connection device has a locking device for locking the connected portions and at least two bolts, with the bolts being anchored firmly in a part of the board and being insertable into respective holes of the other part of the board.

CN203345156U, published on the 18, Dec. 2013 by Hongzhou Liangjin Boat Co LTD, relates to an assembly, combining a surfboard, a paddle and a sailing boat in one structure. The assembly comprises a base plate, an end buckle plate, a left buckle plate and a right buckle plate, wherein the end buckle plate is of a U shape. The assembly can be used as a surfboard, a paddle board, or sailing boat by fixedly assembling different parts together.

The boards known from the prior art are difficult to assemble and non-practical for easy transportation.

SUMMARY OF THE INVENTION

It is an object of the invention to provide a kiteboard, which is adaptable to a wide range of different conditions. A further object of the invention is to provide a board which can be easily stored and transported in a space-saving way.

A kite board according to the invention comprises a base, at least one front extension and/or at least one back extension. The base comprises a top face and a bottom face and an outer edge face. The top face is hereby understood as the face, on which the rider stands during riding and the bottom face as the face that during riding is placed in the direction of the water. The outer edge face of the base is extending in a circumferential direction along an outer contour of the top face and the bottom face and comprises a first mechanical interface. The front extension and/or the back extension also comprise a top face and a bottom face. Furthermore they comprise an inner edge face. The inner edge face extends between the top face and the bottom face along an inner contour in a circumferential direction and is shaped such that it corresponds at least partially to the outer contour of the base. The inner edge face of the front and/or the back extension comprises a second mechanical interface, which, in an assembled position, is foreseen to be engaged with a corresponding first mechanical interface of the base. The first and the second interface are engaged with each other to position the front extension, respectively the back extension with respect to the base. Alternatively or in addition, the first and the second mechanical interface can be arranged adjacent to the inner and the outer edge face in the area of the top face.

By combining the base with different front and/or back extensions the width (in a lateral direction) and/or the length (in a longitudinal direction) of the overall kiteboard may be adjusted. Hence, a modular setup can be arranged with a fully functional base and one or several front and back extension. One base can be interconnected with one or several front and back extensions via the first and the second mechanical interface thereby covering the full spectrum of different applications of a kiteboard. Thus, for each user an individual a kit may be provided comprising a base and at least two front extensions and/or at least two back extensions such that a user can exchange the front and/or back extension to generate different kiteboards with different performance characteristics. In some applications, the base may thereby be a fully functioning kiteboard in itself. In the situation where the base acts as a kiteboard, the outer edge face of the base, respectively transition region of the outer edge face and the bottom face of the base are developed as a so called riding edge which, during riding, is actively taking influence on the riding behavior as it interacts with the water surrounding the kiteboard. In this case the edge acts as flow breakaway edge. Thus, a riding edge is preferably optimized fluid-mechanically as well as in terms of the structural properties since a riding edge experiences a stronger wear than e.g. the top face of a kiteboard. Therefore the edges of kiteboards, respectively the riding edges, are usually strengthened. This may be done e.g. by turning over the fibers at the edge of a fiber reinforced board such that no ends of fiber layers are exposed at the outer edge face and/or by using reinforcing fill materials at the edges. Additionally or alternatively, the riding edge may comprise a reinforcing element, preferably a reinforcing strip which in placed on and thus reinforces the outer edge face. The reinforcing element may e.g. be made from ABS-plastic. If the base can be used as a kiteboard, the base may represent a narrow kiteboard board which is known to be faster than a wider board. A kiteboard with a greater width can be generated by combining the base with a front and/or a back extension which is results in more stable driving characteristics. Preferably, the width of the base is between $W_B$=0.26-0.38 m such that is may be used without front or back extensions. Advantageously, the width of the kiteboard can then be extended up to $W_K$=0.5 m in various steps by using different front and/or back extensions. Depending on the application the length of the base may be changed together with the width or independently.

Next to the width and the length of the kiteboard, the shape of the overall contour of the kiteboard can be adapted. This may be done by either using both extensions (front and back extension), having different shapes or by using only one of the front or the back extension. E.g. the base may be a so-called "twin-tip" kiteboard, as known from the prior art, which has a symmetrical and longitudinal form and can be used in the positive and the negative longitudinal direction. However, in combination with the front and/or the back extension an overall shape of a (non-symmetrical) raceboard may be generated. Depending on the application, the front and/or back extension may further comprise an additional floating member.

For the interconnection of the base with the front and or the back extension, the first and the second mechanical interface can comprise a notch and a thereto corresponding tongue at least partly over the circumferential length of the outer edge face and/or the inner edge face. Alternatively or in addition other mechanical interconnection means e.g. such as pins insertable in respective holes may be used. Preferably, the notch is arranged in the outer edge face of the base and the tongue is arranged in the inner edge face of the front and/or the back extension. If the outer edge face of the base is riding edge, as described above, such that the base may be used as a kiteboard alone (without the first and the second extension), this setup is advantageous in terms of water-board interaction since a tongue extending from the base creates unnecessary drag and affects the overall board performance in a negative way.

Advantageously, the front extension and/or the back extension extend in the assembled position around the base and meet each other at a widest area of the base of the kiteboard, i.e. approximately in the middle with respect to the longitudinal direction of the kiteboard. The widest area is hereby defined as the area where the base has in a lateral direction the greatest width (with the kiteboard extending in longitudinal direction). The front extension may additionally comprise a third mechanical interface on a side face between the top and the bottom face foreseen to abut against a respective forth mechanical interface of the back extension on a side face between the top and the bottom face of said back extension. The third and fourth mechanical interfaces may also comprise a notch and a thereto corresponding tongue engaging into each other, as described above.

For an advantageous fluidic design, the bottom face of the front extension and/or the back extension in the assembled position continuously merges into the bottom face of the base. Thus, if the kiteboard is moved over the water surface, the drag is minimized due to a smooth surface with no abrupt gradients in the bottom face due to the interconnection of the base to the front and/or back extension.

For a stable interconnection at least one first locking element may be present to (releasable) lock the front extension and/or the back extension with respect to the base in the assembled position. The locking element hereby preferably interconnects (respectively the application of interconnection forces), the base, the front and/or the back extension in longitudinal and in lateral direction of the kiteboard, which yields a more robust structural interconnection. Alternatively or in addition to that, the at least one first locking element may also lock the front extension with respect to the back extension in the assembled position. For an advantageous design in terms of the fluidic drag, the at least one first locking element is hereby preferably located on the top face of the base and/or top face of the front extension and/or the back extension, where no direct water-board interaction takes place. A placement on an outer side face of the kiteboard (extending between the top face and the bottom face in circumferential direction around the kiteboard) is also disadvantageous, since the design and shape of the kiteboards edge is also known to influence the board's performance.

In a preferred variation of the invention, the at least one first locking element comprises a tension element, at least two deflecting members and one cord. Hereby, the cord is wound around the at least two deflecting members and the tension element tightens the chord around said deflecting members. The deflecting member deflects the cord in a way that a deflection angle is generated between the incoming cord and the outgoing part of the cord at the deflecting member. Preferably, the deflecting member features therefore a guiding indentation such that the chord is prevented from slipping of. In one variation, the tension element may also deflect the chord. The advantage of this arrangement is the easy handling and the possibility to assemble different combinations. A further advantage is the low profile arrangement which does not significantly stick above the top surface of the board.

If the parts which shall be interconnected are engaged by means of the first and the second mechanical interface (pre-assembled position), the cord is wound around the respective deflecting members and tensioned by the tension element. For an easy storage of the cord it is further advantageous, if the tension member comprises a feeder roll wish can stash excessive cord and/or the cord over the full cord length if the cord is not in use.

If both extensions (front and back extension) are used, two first locking elements are preferably placed on the top face of the base and/or the top face of the front and/or the back extension, with each locking element located in the area of the intersection of the base, the front extension and the back extension. In this case, at least three but preferably four deflecting members may be used for each locking element. In the case of four deflecting members, the cord forms a rectangle with a deflecting member at each corner of the rectangle, deflecting the cord by 90 deg. Thus, if one deflecting member is placed on the front extension, one deflecting member on the back extension and two deflection members on the base the front extension and the back extension are secured against each other meanwhile at the same time the front and the back extension are secured, respectively braced, against the base and against each other—which generates strong and evenly balanced interconnection forces in the lateral as well as longitudinal direction if the cord is retensioned by the tension member. The latter is hereby preferably placed along a straight part of the (rectangular formed) chord on either part of the kiteboard (base, front or back extension) such that only unidirectional forces apply on the tension member.

For a space saving design, the base may further be dividable in at least two parts. This minimizes further the transportation space needed. Therefore a first and a second base part may be provided, each comprising an interconnection face extending between the top face and the bottom face of the base foreseen to abut against each other. Each interconnection face may comprise a mechanical interface, as described above. Furthermore, the first and the second base parts may be secured in an interconnected position by the at least one first locking element in the same way as described above and/or by at least one second locking element, interconnecting the first and the second part of the base independently. The second locking element may be e.g. a buckle.

In a further variation of the invention, at least one fin is releasably attached to the base and/or the front extension and/or the back extension. Therefore, the base and/or the front extension and/or the back extension may comprise at least one first insert for the attachment of the fin on the bottom face. Since the optimal placement of a fin depends on the size of each board, the fin's position is preferably adaptable. Furthermore, the exact placement influences certain board characteristic such as the turning ability and the grip. Therefore, advantageously, different fins having different sizes and shapes may be places on various locations on the kiteboard and can be easily exchanged and/or relocated. The fin may e.g. be attached by means of a thread or a quick fastener. Depending on the application, the base may comprise at least one second insert for the releasable attachment of a foil on the bottom face. Due to the higher forces on a foil in respect to the forces on a fin, the second insert may be designed, respectively scaled, differently than the first insert. Furthermore, the front and/or back extension may comprise an additional floating member to compensate the added weight of the foil. Preferably, the first and the second inserts are designed in a way that no reach-through is generated from the bottom face to the top face. Otherwise the pressure differences from the top and the bottom face, caused by the moving kiteboard, might cause the water to be pressed though the insert when the kiteboard is in use and create a fountain.

It is to be understood that both the foregoing general description and the following detailed description present embodiments, and are intended to provide an overview or framework for understanding the nature and character of the disclosure. The accompanying drawings are included to provide a further understanding, and are incorporated into and constitute a part of this specification. The drawings illustrate various embodiments, and together with the description serve to explain the principles and operation of the concepts disclosed.

BRIEF DESCRIPTION OF SEVERAL VIEWS OF THE DRAWINGS

The herein described invention will be more fully understood from the detailed description given herein below and the accompanying drawings which should not be considered limiting to the invention described in the appended claims. The drawings are showing:

DETAILED DESCRIPTION OF THE INVENTION

Reference will now be made in detail to certain embodiments, examples of which are illustrated in the accompanying drawings, in which some, but not all features are shown. Indeed, embodiments disclosed herein may be embodied in many different forms and should not be understood as limited to the embodiments set forth herein; rather, these embodiments are provided so that this disclosure will satisfy applicable legal requirements. Whenever possible, like reference numbers will be used to refer to like components or parts.

Figure 1:
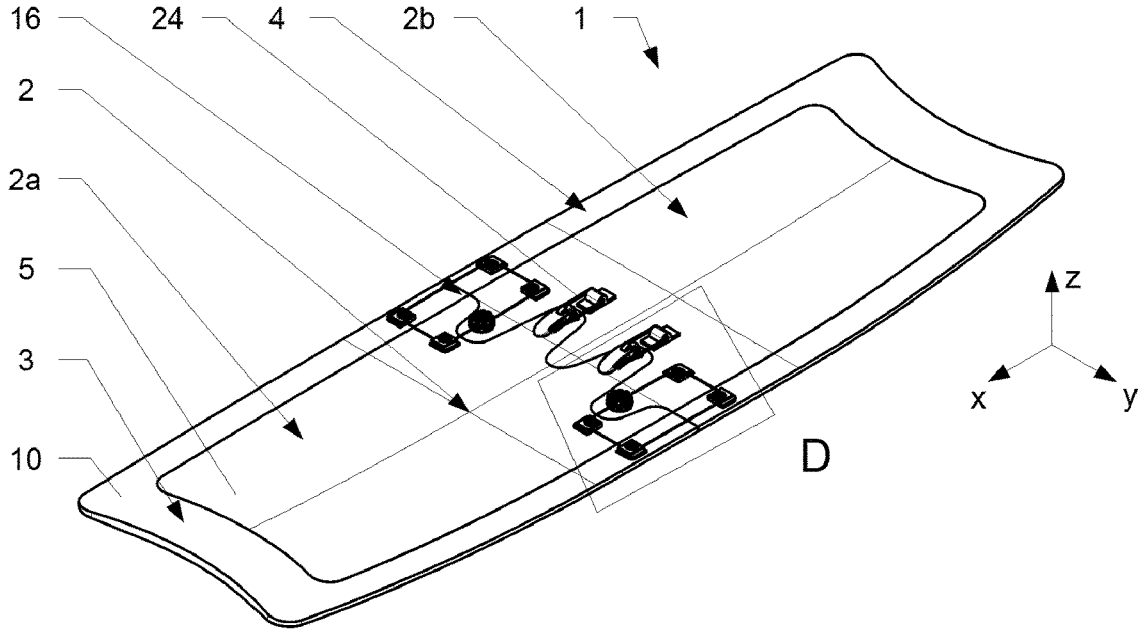
FIG. 1 a first variation of the kiteboard according to the invention in the assembled position in a perspective view.

FIG. 1 shows a first variation of the kiteboard 1 according to the invention in a perspective view and in the assembled position from above. The shown kiteboard 1 comprises a base 2, a front extension 3 and a back extension 4 such that the front extension 3 and the back extension extend around the base 2 and meet each other at a widest area (in the lateral direction y) of the base 2. It can further be seen that in the shown variation the base 2 may be divided in a first part 2*a* and a second part 2*b*. In the perspective view of FIG. 1, a top face 5 of the base 2, respectively a top face 10 of the front and the back extension 3, 4 are facing upwards (positive z-direction) and can be thus seen in said view. In the assembled position an outer side face 7 extending in a circumferential direction along an outer contour 8 of the top face 5 and the bottom face 8, cannot be seen directly however, an edge of the top face 5 of the base 2 being flush mounted to an edge of the top face 10 of the front and back extension 3, 5 can be detected. Furthermore, it can be seen that the bottom face 11 of the front extension 3 and/or the back extension 4 in the assembled position advantageously merge continuously into the bottom face 6 of the base 2, such that fluidic drag can be reduced, when in use.

Figure 2:
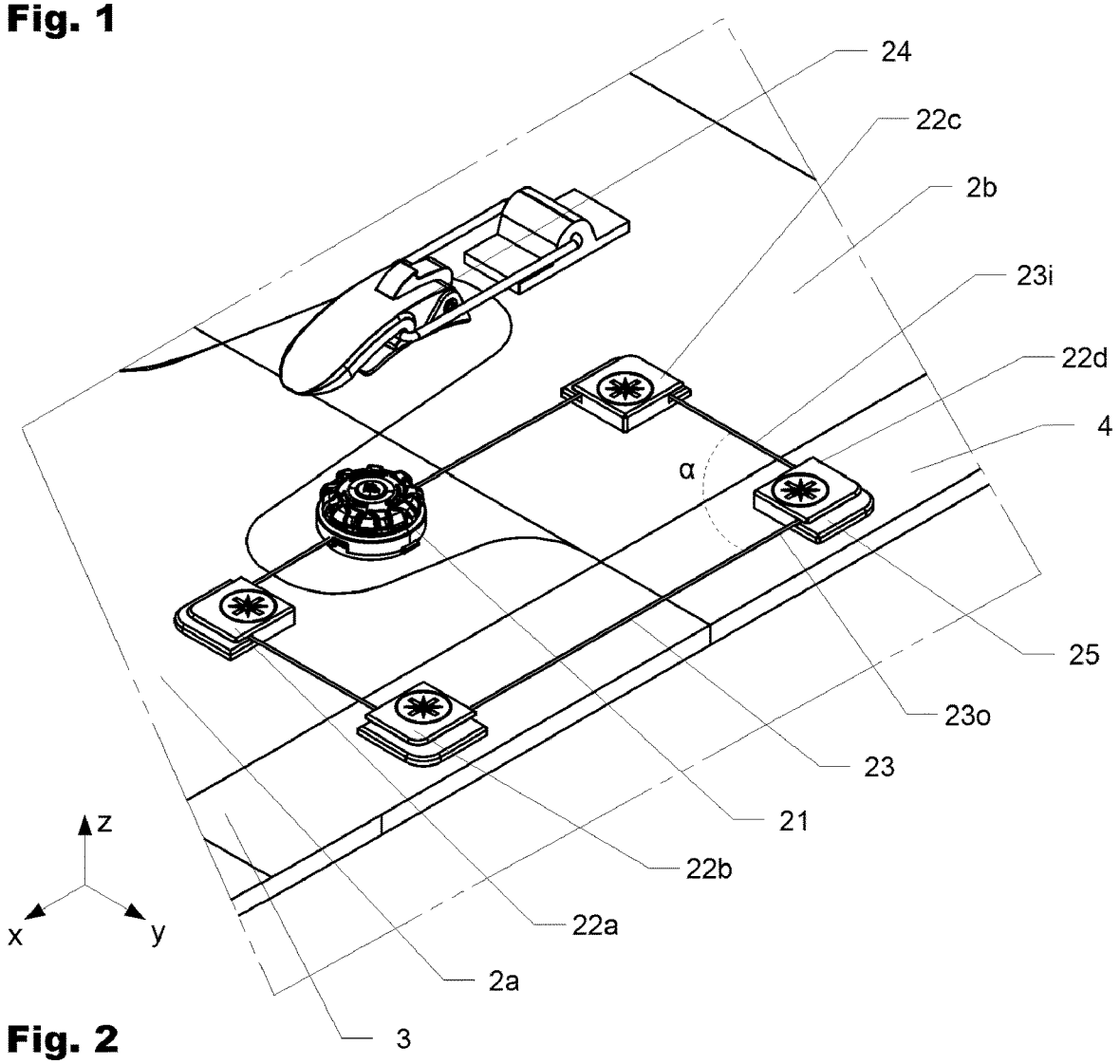
FIG. 2 a detail of the kiteboard according to FIG. 1.

On the top faces 5, 10 first and second locking elements 16, 24 can be seen, which are illustrated in more detail in FIG. 2. The first locking element 16 locks the front extension 3 and/or the back extension 4 with respect to the base 2 in an assembled position. Preferably, the at least one first locking element 16 also locks the front extension 3 with respect to the back extension 4 in the assembled position. Meanwhile, the first and the second part 2*a*, 2*b* of the base 2 may be interconnected separately by at least one second locking element 24, placed on the top face 5 of the base 2. The first locking element 16 hereby comprises preferably a tension element 21, at least two deflecting members 22 and one cord 23. Hereby, the cord 23 is first wound around the at least two deflecting members 22 in a pre-assembled position (with the base and front and/or back extension interconnected at least through the first and second mechanical interfaces) and then the tension element 21 tightens the cord 23 around said deflecting members 22. In the shown application, the deflecting member 22 deflects the cord 23 by a deflecting angel of alpha=90 deg between the incoming cord 23*i* and the outgoing part of the cord 23*o* at the deflecting member 22 (compare FIG. 2, deflection member 22*d*). However, depending on the amount of deflecting members 22 used, the deflection angle may vary. To avoid that the cord 23 may slip from the deflecting members 22, the deflecting members 22 may comprise a guiding indentation 25, in which the cord 23 is guided and secured over the length of the deflection. (In the assembled position the cord 23 is taut and thus straight between each deflecting member 22.)

Figure 3:
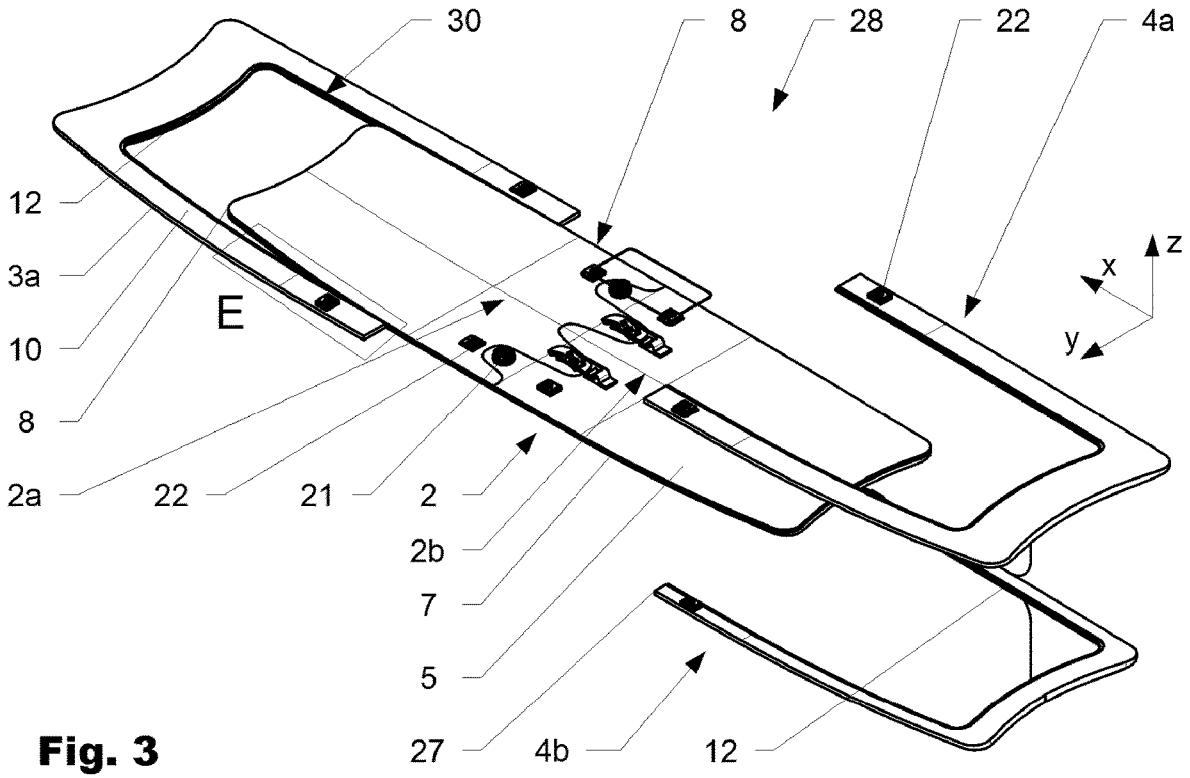
FIG. 3 a first variation of a kiteboard kit in a partly disassembled position in a perspective view.
Figure 4:
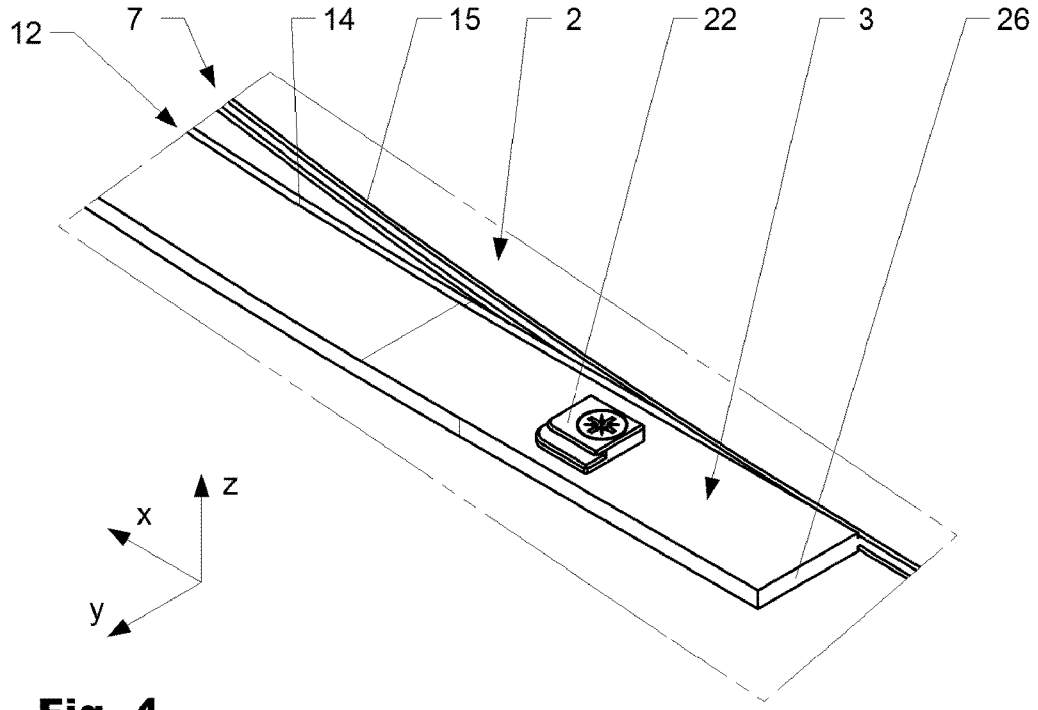
FIG. 4 a detail of the kiteboard kit according to FIG. 3.

In FIG. 3 a kit 28 is illustrated comprising a base 2 and at least two front extensions 3*a*, 3*b* and/or at least two back extensions 4*a*, 4*b* (3*b* not shown here). In the shown example, combining the base 2 with the back extension 4*a* and the respective front extension 3*a* generates a wider and also a longer kiteboard 1*a* than a kiteboard 1*b* using the base, the front and back extension 3*b*, 4*b*. However, also other front and back extensions shapes may be used in a kit 28. The illustrated kiteboard kit 28 can be seen in a partly disassembled position which offers a view on the outer and inner edge faces 7, 12. An outer edge face 7 of the base 2 can be seen that is extending in a circumferential direction along an outer contour 8 of the top face 5 and a bottom face 6. Said outer edge face 7 is comprising a first mechanical interface 9 for the interconnection of the front and/or the back extension via a second mechanical interface 13 of the front and/or the back extension. Hereby an inner edge face 12 of the front and/or the back extension extends between the top face 10 and the bottom face 11, corresponds at least partially to the outer contour 8 of the base 2 and comprises said second mechanical interface 13. In the assembled position the first and the second mechanical interfaces 9, 13 are engaged with each other to position the front extension 3 and/or the back extension 4 with respect to the base 2. In the illustrated case, the first and the second mechanical interface 9, 13 comprise a notch 14 and a thereto corresponding tongue 15 with the notch 14 being arranged in the outer edge face 7 and the tongue 15 being arranged in the inner edge face 12. However, other mechanical interconnection means such as e.g. pins party insertable in respective holes may be used.

Figure 5:
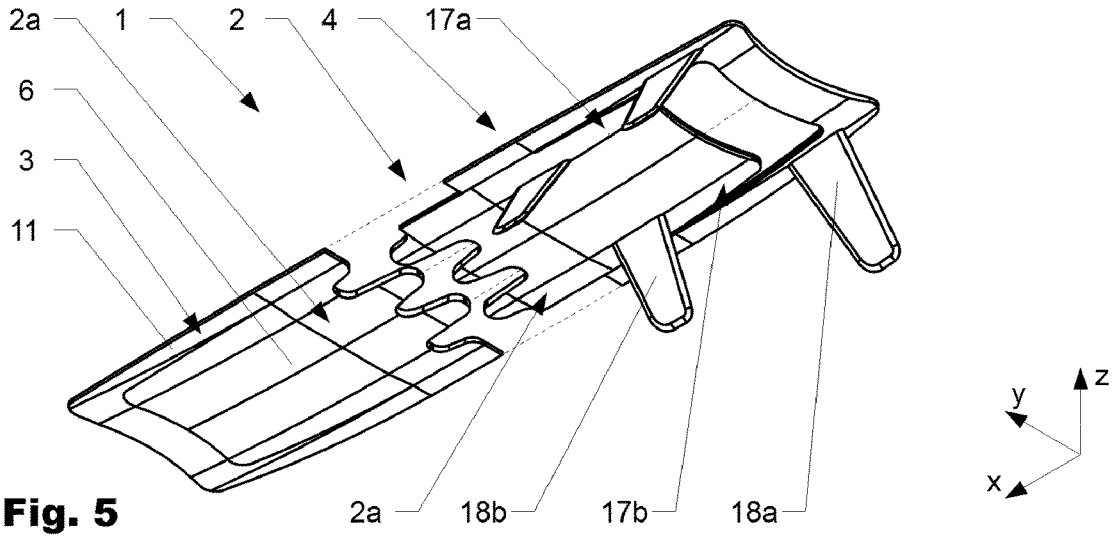
FIG. 5 a second variation of the kiteboard according to the invention having an additional fin in a perspective view from below.

In FIG. 5 a second variation of the kiteboard 1 according to the invention can be seen from a perspective view from below on the bottom faces 6, 11. In this variation the kiteboard 1 further comprises at least one first insert 17 to which at least one additional fin 18 may be attached. In the shown application two (not used) first inserts 17*a*, 17*b* are located in the base 2. Furthermore, in total four fins 18*a*, 18*b* are illustrated attached to the base 2 and the back extension 4 via further first inserts 17, which are concealed by the presence of the fins 18*a*, 18*b*. However, a user may change the position of the fins 18*a* and 18*b* due to personal preferences or according to the local weather and water conditions using other insert positions such as e.g. the positions of the first inserts 17*a*, 17*b*. The amount and the position of the first inserts 17 may vary depending on the individual application.

In the variation of the kiteboard 1 according to FIG. 1 to FIG. 5, the base 2 as well as the overall kiteboard 1 have a shape of a so-called twin-tip board with the front and back extensions 3, 4 being essentially U-shaped. However, other shapes of base 2, the front and back extensions 3, 4 are also possible. The fins 18*a* 18*b* as illustrated in FIG. 5 are therefore also applicable to a kiteboard 1 in the shape of e.g. a raceboard.

Figure 6:
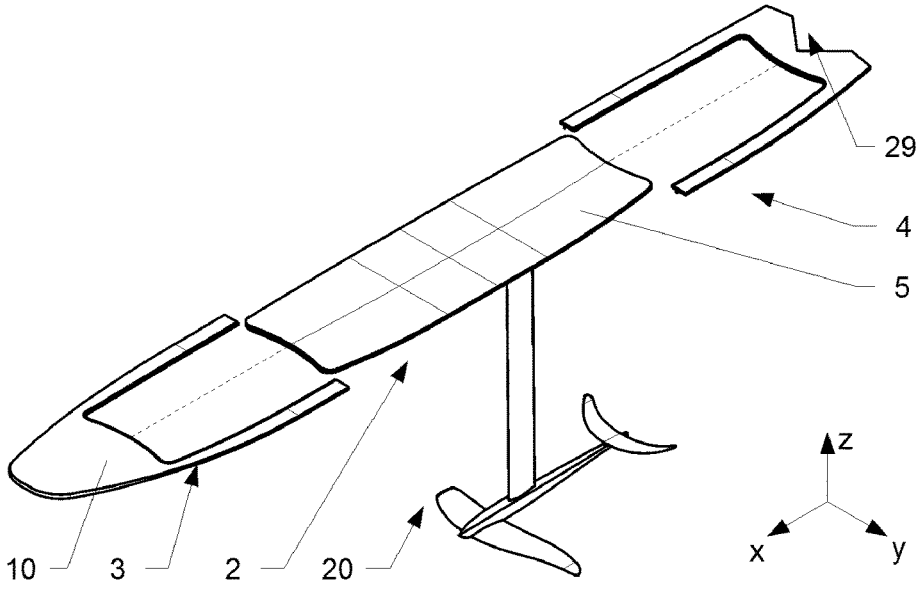
FIG. 6 a third variation of the kiteboard according to the invention having an additional foil in a perspective view from above.
Figure 7:
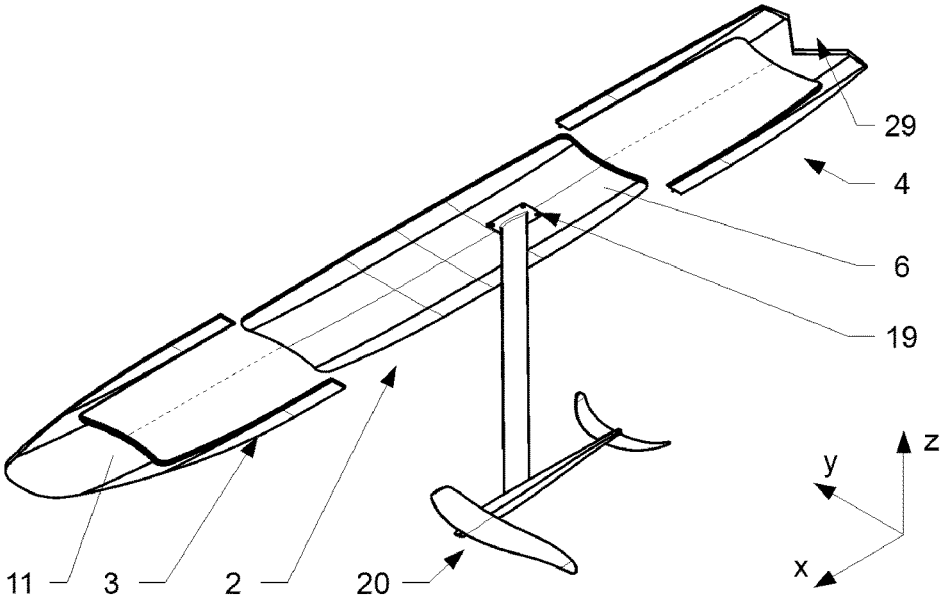
FIG. 7 the kiteboard according to FIG. 6 in a perspective view from below.

FIG. 6 and FIG. 7 illustrate a third variation of the kiteboard 1 according to the invention. FIG. 6 shows the perspective view on the top face 5, 10 and FIG. 7 on the respective bottom face 6, 11. The third variation of the kiteboard 1 is an example of the front extension 3 and the back extension 4 being different from each other such that an overall new shape of the kiteboard 1 is generated in view of the base 2. In this case, the base 2 has the shape of a "twin-tip" board, meanwhile the kiteboard 1 in the assembled position has the shape of a race board, which has a greater extension in longitudinal direction and may additionally feature a triangular cutout 29 at the end of the back extension. Additionally, the kiteboard 1 may be supplemented with a foil 20. In this variation the kiteboard 1 therefore comprises at least one second insert 19 over which at least the additional foil 20 may be attached. Due to the higher forces acting on the foil 20, the at least one second insert 19 may be larger in dimension than the first insert 17. Additionally of alternatively, the base 2 may comprise a feed-through to insert part of the foil 20 and fixate the foil 20 on the top face 5 (not shown here).

The words used in the specification are words of description rather than limitation and it is understood that various changes may be made without departing from the spirit and scope of the invention.

The invention claimed is:

1. A kiteboard (1) comprising:

a. a base (2) comprising i. a top face (5) and a bottom face (6) wherein the top surface is configured to receive a rider standing while riding the kiteboard, and wherein the bottom face is oriented in a direction of water while riding the kiteboard and ii. an outer edge face (7) extending in a circumferential direction along an outer contour (8) of the top face (5) and the bottom face (6) and comprising a first mechanical interface (9), wherein the outer edge face (7) of the base (2) is a riding edge such that the base is a fully functioning kiteboard in itself;

b. a front extension (3) and/or a back extension (4) comprising a top face (10) and a bottom face (11) and an inner edge face (12) extending between the top face (10) and the bottom face (11) along an inner contour (30), wherein c. the inner edge face (12) corresponds at least partially to the outer contour (8) of the base (2) and comprises a second mechanical interface (13), wherein d. in an assembled position the first and the second mechanical interface (9, 13) are engaged with each other to position the front extension (3) and/or the back extension (4) with respect to the base (2).

2. The kiteboard (1) according to claim 1, wherein the first and the second mechanical interface (9, 13) comprise a notch (14) and a thereto corresponding tongue (15).

3. The kiteboard (1) according to claim 2, wherein the notch (14) is arranged in the outer edge face (7) and the tongue (15) is arranged in the inner edge face (12).

4. The kiteboard (1) according to claim 1, wherein the front extension (3) and the back extension (4) are U-shaped.

5. The kiteboard (1) according to claim 1, wherein the front extension (3) and the back extension (4) in the assembled position extend around the base (2) and meet at a widest area of the base (2).

6. The kiteboard (1) according to claim 1, wherein the bottom face (11) of the front extension (3) and/or the back extension (4) in the assembled position continuously merges into the bottom face (6) of the base (2).

7. The kiteboard (1) according claim 1, wherein at least one first locking element (16) in the assembled position locks the front extension (3) and/or the back extension (4) with respect to the base (2).

8. The kiteboard (1) according to claim 1, wherein at least one first locking element (16) in the assembled position locks the front extension (3) with respect to the back extension (4).

9. The kiteboard (1) according to claim 8, wherein the at least one first locking element (16) is located on the top face (10) of the base (2) and/or top face (10) of the front extension (3) and/or the back extension (4).

10. The kiteboard (1) according to claim 1, wherein at least one fin (18) is releasably attached to the base (2) and/or the front extension (3) and/or the back extension (4).

11. The kiteboard (1) according to claim 1, wherein the base (2) comprise a second insert (19) to which a foil (20) is releasably attached.

12. The kiteboard (1) according to claim 1, wherein the front extension (3) and/or the back extension (4) comprises a floating member.

13. The kiteboard (1) according to claim 1, wherein the base (2) is dividable in at least two parts.

14. A kit comprising a base (2) and at least two front extensions (2) and/or at least two back extensions (3) according to claim 1.

15. The kiteboard (1) according to claim 1, wherein the front extension and/or the back extension is a first front extension and/or a first back extension, and further comprising:

a second front extension and/or a second back extension, wherein the second front extension and/or the second back extension is interchangeable with the first front extension and/or first back extension, and wherein the second front extension and/or the second back extension is different from the first front extension and/or the first back extension.

16. The kiteboard (1) according to claim 15, wherein the second front extension and/or the second back extension is adapted for a water or weather condition that is different than for the first front extension and/or a first back extension.

17. The kiteboard (1) according to claim 1, wherein the front extension and/or the back extension further includes a second riding edge along an extension outer contour of the front extension and/or the back extension, wherein the base kiteboard and the riding edge are adapted for a first water condition, and the front extension and/or the back extension and the second riding edge is adapted for a second water condition which is different than the first water condition.

18. The kiteboard (1) according to claim 17, wherein each of the riding edge and the second riding edge is structured to interact with the water during the riding of the kiteboard.

19. A kiteboard comprising:

a. a base kiteboard that is a fully functioning kiteboard in itself, the base kiteboard comprising:

i. a top face configured to receive a rider, ii. a bottom face oriented in a direction of water while the rider is riding the kiteboard, and iii. a first riding edge, the first riding edge comprising an outer edge face extending in a circumferential direction along an outer contour of the top face and the bottom face and comprising a first mechanical interface, b. a first front extension and/or a first back extension comprising a top face and a bottom face, a second riding edge along a first extension outer contour of the first front extension and/or the first back extension, and an inner edge face extending between the top face and the bottom face along an inner contour, wherein c. the inner edge face corresponds at least partially to the outer contour of the base kiteboard and comprises a second mechanical interface, wherein d. in an assembled position the first and the second mechanical interface are engaged with each other to position the first front extension and/or the first back extension with respect to the base kiteboard, e. wherein the base kiteboard can be interconnected with the first front extension and/or the first back extension for a first different water condition.

20. The kiteboard of claim 19, further comprising:

a second front extension and/or a second back extension comprising a top face and a bottom face, a third riding edge along a second extension outer contour of the first front extension and/or the first back extension and an inner edge face extending between the top face and the bottom face along a second extension inner contour, wherein the base kiteboard can be interconnected with the second front extension and/or the second back extension for a second different water condition which is different than the first different water condition.

* * * * *